US006254907B1

(12) United States Patent
Galomb

(10) Patent No.: US 6,254,907 B1
(45) **Date of Patent: *Jul. 3, 2001**

(54) BOWL BAG WITH RESEALABLE CLOSURE MEANS

(75) Inventor: David E. Galomb, Allentown, PA (US)

(73) Assignee: Fres-co System USA, Inc., Telford, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/559,445

(22) Filed: Apr. 27, 2000

Related U.S. Application Data

(63) Continuation-in-part of application No. 09/468,600, filed on Dec. 21, 1999.

(51) Int. Cl.[7] ..... B65D 85/804; B65D 85/816

(52) U.S. Cl. ..... 426/115; 426/120; 426/122; 426/124; 383/40; 383/65; 383/104; 383/204; 206/541

(58) Field of Search ..... 426/120, 115, 426/112, 124, 111, 122; 383/104, 204, 40, 61, 63, 65; 206/541

(56) References Cited

U.S. PATENT DOCUMENTS

| | | | | |
|---|---|---|---|---|
| 2,647,681 | * | 8/1953 | Paoli | 206/219 |
| 3,679,093 | * | 7/1972 | Chang | 220/90.2 |
| 4,576,285 | | 3/1986 | Goglio | 206/632 |
| 4,637,061 | * | 1/1987 | Riese | 383/38 |
| 4,705,174 | | 11/1987 | Goglio | 206/632 |
| 4,837,849 | * | 6/1989 | Erickson et al. | 383/104 |
| 4,892,512 | * | 1/1990 | Branson | 493/194 |
| 4,913,561 | | 4/1990 | Beer | 383/94 |
| 4,930,637 | * | 6/1990 | DeRoseau | 206/541 |
| 5,038,974 | | 8/1991 | DaCosta | 222/106 |
| 5,075,119 | * | 12/1991 | Mendenhall | 426/113 |
| 5,090,572 | * | 2/1992 | DeRoseau | 206/542 |
| 5,174,658 | * | 12/1992 | Cook et al. | 383/33 |
| 5,375,930 | * | 12/1994 | Tanni | 383/206 |
| 5,499,763 | | 3/1996 | DeMars | 229/114 |
| 5,721,025 | * | 2/1998 | Falla et al. | 428/35.2 |
| 5,727,679 | | 3/1998 | Newarski | 206/222 |
| 5,851,069 | * | 12/1998 | Davoren | 383/38 |

* cited by examiner

*Primary Examiner*—Milton Cano
*Assistant Examiner*—Sherry A. Dauerman
(74) *Attorney, Agent, or Firm*—Caesar, Rivise, Bernstein, Cohen & Pokotilow, Ltd.

(57) ABSTRACT

Flexible packages for holding a product, e.g., dry cereal, which are arranged to be opened to form a bowl to enable the product to prepared therein and/or eaten therefrom. The packages each basically comprises a front panel, a rear panel, and a bottom panel, all formed of a flexible sheet material. The front and rear panels each include a top edge, a pair of opposed side edges, and a bottom edge. The front and rear panels are fixedly secured together along the side edges. The peripheral edge of the bottom panel is fixedly secured to the inside surface of the front and rear panels above their bottom edges to form a hollow pocket for receipt of the product. The front and rear panels of each package are sealed along their top edges to isolate the product in the pocket from the ambient atmosphere, but are separable, e.g., can be severed, adjacent their top edges to enable the front and rear panels to separate to convert the pocket into a bowl. The product can then be prepared, e.g., milk added, and/or eaten from the bowl. The bottom edges of the front and rear panels form a support base for the bowl. An eating utensil, e.g., a spoon, may also be packaged with the product within the pocket. The package may also include one or more additional compartments to hold additional products, e.g., sugar and powdered milk. In addition the package may include a resealable securable closure, e.g., a zipper-type closure, to reclose the bowl after it has been formed.

15 Claims, 8 Drawing Sheets

FIG. 1
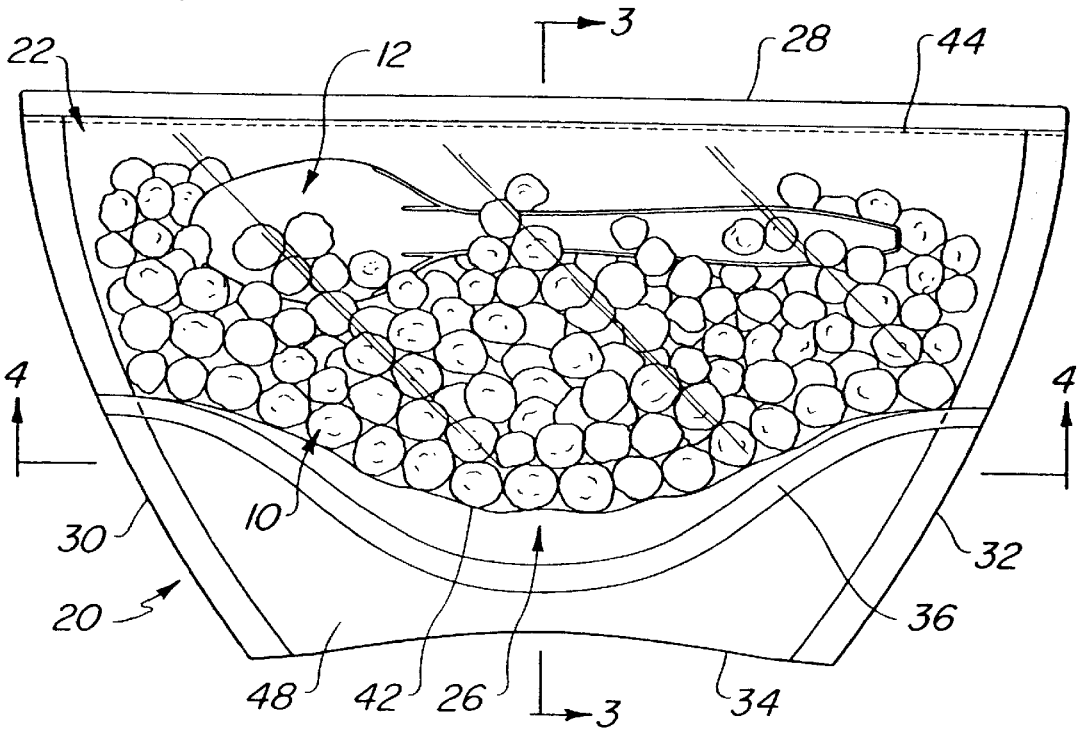
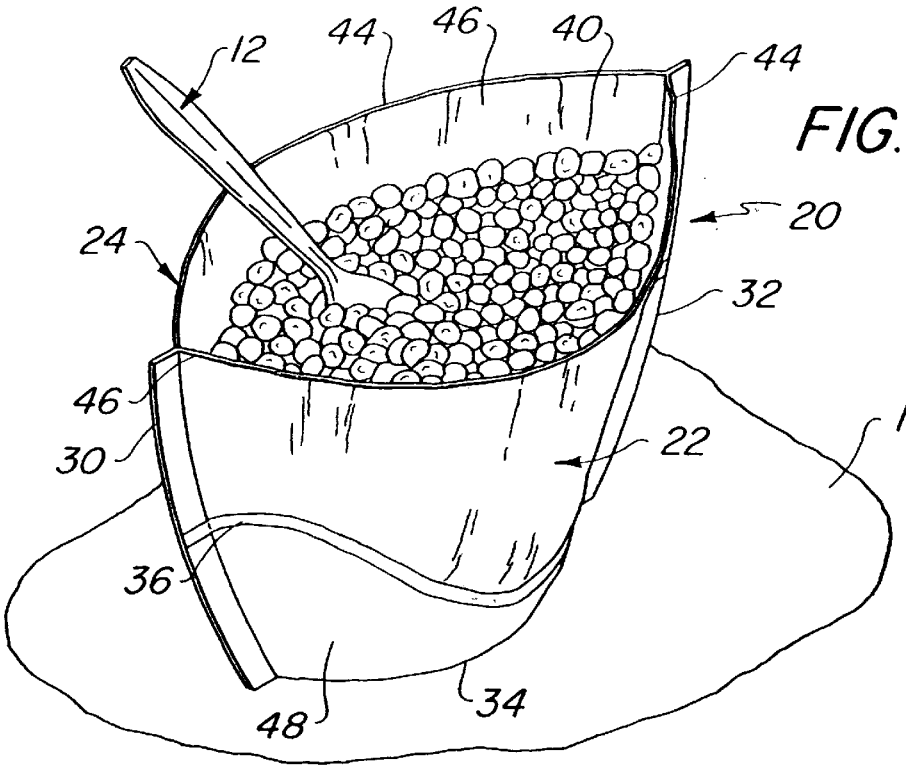
FIG. 2

FIG. 15
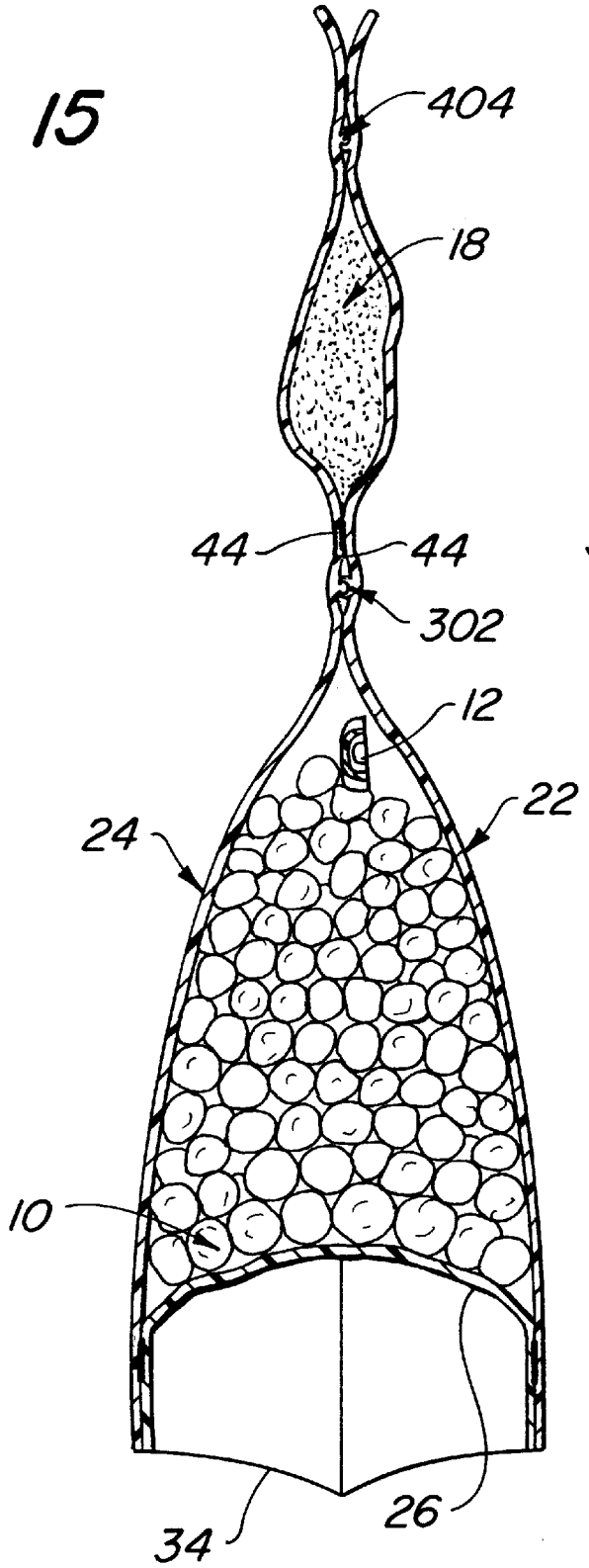
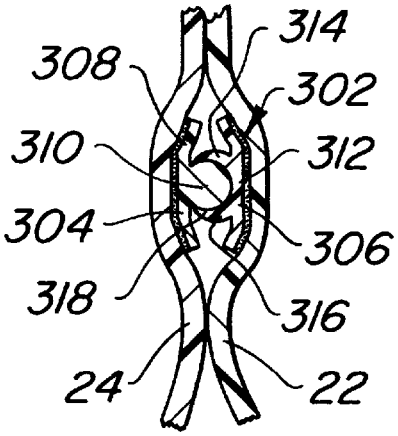
FIG. 16

BOWL BAG WITH RESEALABLE CLOSURE MEANS

RELATED APPLICATION

This application is a Continuation-In-Part of U.S. patent application Ser. No. 09/468,600, filed on Dec. 21, 1999, whose disclosure is incorporated by reference herein.

BACKGROUND OF THE INVENTION

This invention relates generally to flexible packages, and more particularly to flexible packages for holding food or other edible products, and which once opened are arranged to serve as bowls from which the food or other edible product(s) may be eaten.

Various types of flexible packages for holding particulate materials, e.g., ground or whole bean coffee, agricultural products, such as seeds, chemicals, etc., under vacuum therein have been disclosed in the patent literature and are commercially available today. Examples of such packages are found in the following U.S. Pat. No. 4,576,285 (Goglio), U.S. Pat. No. 4,705,174 (Goglio), and U.S. Pat. No. 4,913,561 (Beer). The major advantages of flexible packaging, as compared to relatively rigid packaging, e.g., cartons, are that until the flexible package is filled it takes up very little volume, and after it is emptied of its contents it readily collapses, thereby reducing its volume to approximately that of the unfilled package. The former characteristic is a significant advantage insofar as storage is concerned, while the latter characteristic is a significant advantage from the standpoint of being disposable.

Heretofore many of the prior art flexible packages have included means for providing access to their contents. For example, the heretofore identified U.S. Pat. No. 4,705,174 (Goglio) discloses a package for coffee which includes a peel strip applied to the inner surface of the package below the top edges. The strip provides an air-tight interfacial seal which can be readily peeled apart to provide access to the interior of the package. Another approach to providing an opening or mouth for a flexible package to provide access to its contents is to score the upper flap of the package by laser or mechanical means through a tear initiation resistant layer(s) of the package structure. In this way the package can be opened by tearing away the scored area to form the package's mouth. The contents of the package can then be dispensed for use. Flexible packages in the form of stand-up pouches, are commercially available and typically include so-called "zipper-type" closures to provide access to the contents of the package.

Some flexible packages for foods are commercially available and are constructed to enable the food(s) to be eaten directly from the package. For example, microwaveable popcorn is commonly offered in flexible, expandable packages. Such packages are constructed so that portions expand when the package is microwaved so that the popcorn kernels pop to increase their volume. Once the popping is completed the package is arranged to be opened, e.g., torn along a sever line, to enable the popcorn to be eaten directly from the package. U.S. Pat. No. 5,770,839 (Ruebush et al.) discloses one such a microwaveable bag for cooking and serving popcorn.

Conventional stand-up pouches formed of flexible materials have been used for holding foodstuffs, but such pouches are not generally suitable for use as a bowl-like vessel from which food can be eaten because of the shape of such pouches. In this regard a conventional stand-up pouch is usually constructed to have parallel vertical side panels, the width of which being the same from bottom to top. Although such pouches are fairly sturdy in their construction and are arranged to stand upright, the constant width configuration presents a significant inherent shortcoming insofar as ability to serve as a vessel, e.g., a bowl, from which food can be readily eaten. The same holds true for gusseted types of flexible packages.

Conventional pouches or bags made of flexible materials, such as those commonly used for potato chip and popcorn containers, also suffer from significant shortcomings as a vessel from which food can be eaten. Perhaps the most significant drawback is that such pouches do not provide the stability necessary to support the food for eating, particularly if the food, e.g., a dry cereal, is to have a liquid, e.g., milk, introduced into it. Moreover, many of the prior art flexible pouches are designed to be opened from the top, and then laid down when opened. This type of package is thus not conducive for eating a foodstuff to which a liquid is applied, e.g., a dry cereal with milk, directly from the package, since the liquid could run out of the package. Those flexible pouches which are not opened from the top, will typically require making a narrow slit or other opening in one of the panels of the package to provide access to the interior. The slit would of necessity have to be relatively small and/or narrow so as not to compromise whatever stability the package may exhibit. As should be readily appreciated, eating a food from a flexible package through a narrow slit may be difficult at best, particularly if the food has a liquid applied to it, e.g., dry cereal with milk.

The prior art patent literature also includes various disclosures of non-flexible packages for holding and serving foods. For example, U.S. Pat. No. 5,038,974 (DaCosta) discloses a generally parallelopiped food container having a boat shaped handle for holding a flexible bag of food, e.g., baby food. The package also includes a spoon for serving the food.

U.S. Pat. No. 5,727,679 (Newarski) discloses a single use package formed of plastic or fiberboard and defining a preformed bowl for holding cereal and milk or other dry food and beverage. The package also includes a spoon to enable a user to eat directly from the package.

U.S. Pat. No. 5,499,763 (DeMars) discloses a flexible package in the form of a pouch holding a foodstuff, e.g., potato chips, popcorn, peanuts, etc., and a collapsible container formed of a thin material disposed within the pouch in a folded compact condition. The collapsible container is arranged to be removed from the flexible package and unfolded into a bowl-shaped configuration. The foodstuff from the pouch can then be poured into the bowl-shaped container for use.

While the aforementioned prior art are generally suitable for their intended purposes, a need still exists for flexible packages for food products and the like which are simple in construction, low cost, easy to use, and which when opened serves to enable one to eat the food product from the package and/or to prepare the food product therein.

OBJECTS OF THE INVENTION

Accordingly, it is a general object of this invention to provide a flexible package which addresses those needs.

It is a further object of this invention to provide a flexible package which is arranged to hold an edible product therein and which can be converted into a bowl for eating the product therefrom.

It is a further object of this invention to provide a flexible package can be converted into a bowl which is simple in construction.

It is a further object of this invention to provide a flexible package can be converted into a bowl which is easy to use.

It is a further object of this invention to provide a flexible package can be converted into a bowl and which is suitable for holding a wide variety of edible products, both dry and/or liquid.

It is a further object of this invention to provide a hermetically sealed flexible package for edible products which can be converted into a bowl and which will maintain the freshness of the product therein until opened.

It is a further object of this invention to provide a flexible package for edible products which can be converted into a bowl and which also includes a utensil for use with the product.

It is a further object of this invention to provide a flexible package for edible products that can be converted into a bowl to enable one to eat the contents of the package from the bowl, with the package including a resealable securable closure to enable the reclosure of the package.

SUMMARY OF THE INVENTION

These and other objects of the instant invention are achieved by providing packages having an interior for holding a product, e.g., a foodstuff, such as a dry cereal, and which are arranged to be opened to form a bowl in which the foodstuff can be prepared and/or eaten.

The packages each basically comprises a front panel, a rear panel, and a bottom panel, all formed of a flexible sheet material. The front and rear panels each include a top (e.g., linear) edge, a pair of opposed (e.g., arcuate flared) side edges, a bottom (e.g., slightly concave) edge, an exterior surface and an interior surface. The front and rear panels are fixedly secured together at their inside surfaces along the side edges. The bottom panel has a peripheral edge (e.g., is "canoe" shaped) and is fixedly secured along one portion of its peripheral edge to the inside surface of the front panel above the bottom edge of the front panel and is also fixedly secured along the remaining portion of its peripheral edge to the inside surface of rear panel above the bottom edge of the rear panel to form a hollow pocket for receipt of the product.

The packages are arranged to be sealed along the respective top edges of the front and rear panels to isolate the product in the pocket from the ambient atmosphere to maintain its freshness. The front and rear panels are arranged to be separated from each other contiguous with their respective top edges, e.g., portions of the top of the package may be removed to enable the front and rear panels to be separated to convert the pocket into a bowl-like member in which the product is located. The product in the bowl can then be prepared, e.g., milk added in the case where the product is a dry cereal, and/or eaten.

To facilitate that action the bottom edges of the front and rear panels form a support base for the bowl-like member to be seated on any horizontal surface, e.g., a table.

In accordance with one preferred aspect of this invention an eating utensil is also packaged with the product, e.g., a spoon is located within the pocket holding the product.

The package may also include one or more additional compartments to hold additional products, e.g., when the pocket is used to hold a dry cereal, there may be two additional compartments, one for sugar and another for powered milk/cream.

In accordance with another preferred aspect of this invention the package may include a resealable securable closure, e.g., a "zipper-like" closure, to enable the reclosure of the package.

DESCRIPTION OF THE DRAWING

FIG. 1 is a plan view of one embodiment of a flexible package holding a foodstuff therein and which is adapted when opened to serve as a bowl from which the foodstuff may be eaten;

FIG. 2 is an isometric view showing the package of FIG. 1 after it has been opened to form the bowl from which the foodstuff may be eaten;

FIG. 15 is an enlarged sectional view taken along line 15—15 of FIG. 14; and FIG. 16 is an enlarged sectional view of the closure shown within the area designated by the broken circle in FIG. 12, and which closure represents the closure(s) used in the embodiments of FIGS. 11–15.

DETAILED DESCRIPTION OF THE PREFERRED EMBODIMENT

Referring to FIG. 1, there is shown at 20 in FIG. 1 one exemplary embodiment of a flexible package constructed in accordance with this invention. The package 20 basically comprises a modified stand-up pouch or bag arranged to hold any edible product 10, e.g., dry cereal, etc., and which is arranged to be opened to form a bowl from which the edible material can be eaten. The package is formed of a web of any suitable, flexible material, e.g., a liquid impervious material which preferably forms a suitable barrier to the ingress of air through it, such as polyethylene, polyester, polypropylene, metal foil, and combinations thereof in single or multiple plies. The web of material is fabricated into the package 20 in a manner to be described hereinafter. If desired, the material forming the package may be partially or fully transparent or translucent to enable one to view the contents of the package through its walls. In the embodiments shown herein the packages are shown as being transparent, but that is merely exemplary.

Figure 3:
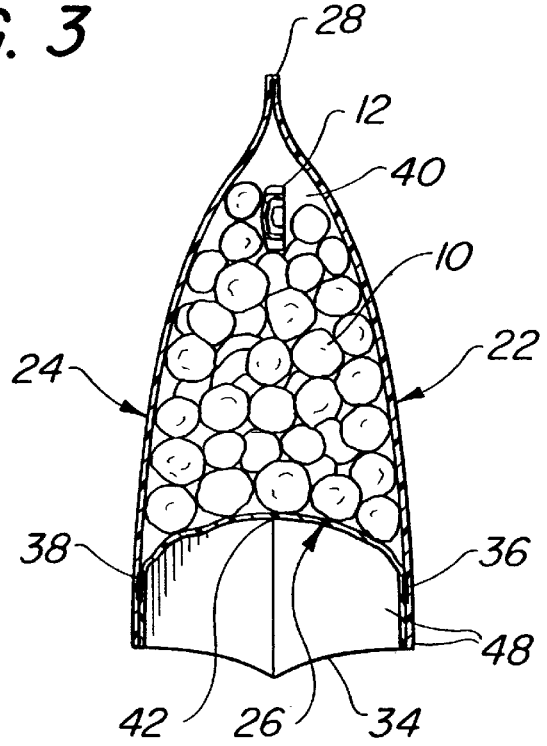
FIG. 3 is a sectional view taken along line 3—3 of FIG. 1.
Figure 4:
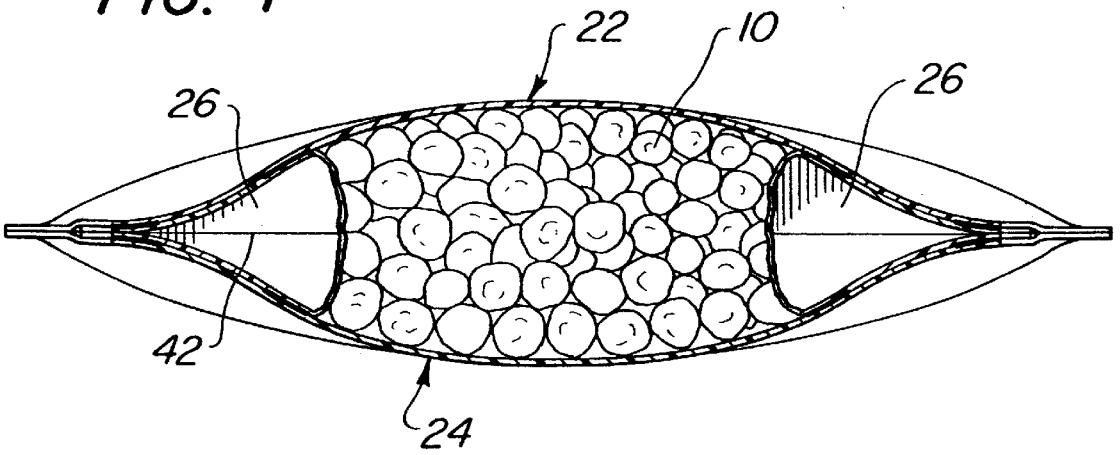
FIG. 4 is a sectional view taken along line 4—4 of FIG. 1.

Turning now to FIGS. 1–4 it can be seen that package 20 includes a front wall or panel 22, a rear wall or panel 24, and a bottom wall or panel 26. In the embodiment shown the front and rear walls or panels each include a linear top edge 28, a pair of opposed arcuate convex side edges 30 and 32, and a slightly concave arcuate bottom edge 34. The bottom wall or panel 26 is of a generally "canoe" shape as best seen in FIG. 4.

As mentioned above the front panel 22, rear panel 24, and the bottom panel 26 are each formed of a sheet or web of the flexible stock material. One particularly useful flexible material for the package 22 is a laminated web of flexible packaging material commercially available from Fres-Co System USA, Inc., of Telford Pa., the assignee of this invention and basically comprises a film laminate of 48 gauge polyester layer which forms the outer surface of the package and a 3 mil polyethylene layer which forms the inner surface of the package.

The front panel 22 and the rear panel 24 are permanently secured or sealed together along their respective arcuate sides edges 30 and 32. The permanent securement may be achieved by any conventional technique, e.g., heat sealing, welding, adhesives, etc. The periphery of the bottom panel 26 is permanently secured or sealed to the inner surface of the front panel 22 and the inner surface of the rear panel 24 along respective seal lines 36 and 38 in order to form a hollow pocket 40 therebetween. The seal lines 36 and 38 are identical in shape, e.g., compound curves, for reasons to be described later. The permanent securement of the bottom panel to the front and rear panels may be achieved by any conventional technique, e.g., heat sealing, welding, adhesives, etc.

It is within the pocket 40 that the foodstuffs or edible product 10 is disposed to be held therein until ready to be eaten or prepared and eaten. The pocket may also be used to hold any type of eating utensil therein. In the exemplary embodiment of FIG. 1, wherein the product is a dry foodstuff, such a dry cereal, the utensil preferably constitutes a spoon 12. However, that utensil may be a fork, knife or any other device for facilitating eating and/or preparation of the foodstuff held within the package 20.

As will be described hereinafter during the fabrication of the package 20 a sheet portion of a web of material forming the bottom wall 26 is folded in half along its major central axis. This fold line is designated by the reference number 42 in the bottom panel and is centered between the seal lines 36 and 38. The folded bottom panel enables the package 20 to be flattened prior to filling and sealing, i.e., the front wall and rear wall can be brought into a confronting relationship with each other with the bottom folded in half therebetween. This enables the package 20 to be readily stored in a compact condition until it is ready to be filled and sealed.

Preferably the package 20 is fabricated in a manner like that used to make a conventional flexible "stand-up" pouch or bag. For example a web of flexible material, e.g., film, is folded to form a generally rectangular front sheet (which will become the front panel 22), a correspondingly shaped rear sheet (which will become the rear panel 24) and a pair of narrower rectangular sheets in the form of a gusset between them. The narrow rectangular sheets making up the gusset will become the folded bottom panel 26. Once that has been accomplished the folded web, i.e., the front sheet is place over the rear sheet with the gusset folded and flattened therebetween, is die cut into the shape of the package shown in FIG. 1. The sheets forming the front and rear panels are permanently secured together, e.g., heat sealed, along their side edges and are also similarly secured to the bottom panel along the bottom seal lines. Once that has been accomplished the package is ready to have its pocket 40 filled with any suitable product 10, e.g., a dry cereal, and optionally a utensil 12.

In order to hold the product 10 within the pocket 40 of the package and maintain its freshness until it is ready to be eaten or prepared and then eaten, the front panel and rear panel are also secured together along their top edges 28, thereby sealing the product in the pocket and completing the package 20. As best seen in FIG. 3 the finished package is of a compact, somewhat flattened "pillow" shape, suitable for ready storage and/or transportation until ready for use.

When it is desired to open the package to eat the product, all that is required is to sever the package along a "sever" line 44 provided immediately below the sealed edges 28. In FIG. 1 this sever line is shown schematically by the dotted or broken line bearing that reference number. The package 20 is arranged to be opened, e.g., the sever line cut with a scissors, knife, or other cutting tool along the entire length of the sever line to remove the heat sealed top edge portion of the package. Printed indicia (not shown) may be applied to the package 20 immediate adjacent the line 44 to give the user instructions on how to form the bowl, e.g., the indicia may state "Cut Here To Create Bowl." The line 44, may if desired, be weakened by any conventional means, so that it can be torn along its length instead of being cut by a scissors or knife.

In any case once the sealed top edge of the package 20 has been removed from above the sever line 44, the natural inclination or propensity of the package, e.g., the resiliency of the film material(s) making up the panels of the package, cause(s) the folded bottom panel 26 to open up and the front and rear panels, 22 and 24, respectively, to separate further from each other, thereby automatically converting the pocket 40 into a bowl-like configuration (hereinafter referred to simply as a "bowl") holding the product 10 therein as shown in FIG. 2.

As will be appreciated by those skilled in the art, if the natural propensity of the material making up the panels of the package is such that it doesn't automatically cause the front and rear panels to separate sufficiently from the flattened pillow shaped configuration to form the desired shaped bowl, the user can facilitate the bowl-formation action. In particular, the user may grasp the free edge 46 of the front panel, i.e., the portion of the front panel 22 contiguous with the line 44, between his/her thumb and index finger of one hand while also grasping the corresponding free edge 46 of the rear panel between his/her thumb and index finger of the other hand to separate the two panels further to completely form the bowl.

As best seen in FIGS. 2 and 3 the portions of the front and rear panels located below the respective seal lines 36 and 38 and the bottom edge 34 of the package forms a support base 48. In particular, the support base 48 serves as a platform upon which the opened package (the bowl) may be seated to support the bowl on any desired horizontal surface, e.g., a table-top 14. If desired, a hot melt adhesive (not shown) may be provided on the panels making up the package's base 48 to provide additional stability for the bowl when disposed on a horizontal surface, like the table top 14.

As best seen in FIGS. 1, the seal lines 36 and 38 are identical in shape and are preferably generally concave to form a rounded bottom for the bowl when the package is opened. In the embodiment shown the seal lines 36 and 38 are each compound curves whose center portion is concave and whose ends are generally convex. It should, of course, be understood that the seal lines can be any other shape, e.g., linear, if desired. So too, while the side seals are shown as being arcuate and flaring outward from the bottom of the package toward the top, thereby establishing a rounded walled bowl when the package is opened, such a construction is merely exemplary. Thus, the side seals may be linear or any other shape. Moreover, the side seals can be oriented vertically or tapered inward from the bottom of the package to the top, instead of the generally flared orientation shown in FIG. 1.

In lieu of having the front and rear panels severable along the line 44, the seal between the top edges of the front and rear panels may not be permanent, as is the case of the side and bottom seals. In particular, the seal between the top edges 28 of the front and rear panels 22 and 24, respectively, may be made peelable so that the user can grip the portions of the front and rear panels at the top edges to peel the panels apart and thereby form the bag into the bowl in a similar manner to that described above. To that end, the peelable seal along the top edges 28 of the front and rear panels may be accomplished by any conventional technique, e.g., it may be formed by making use of easy-opening sealant material (s) on the inner layer, e.g., the 3 mil polyethylene layer, of the front and rear panels contiguous with their top edge 28. Alternatively, the peelable seal along the top edges 28 of those panels can be formed the use of peelable sealing strips like that disclosed in the aforementioned Goglio patents, whose disclosures are incorporated by reference herein, or by any other suitable means or technique(s). In any case, if the top edges of the front and rear panels are to be peelably sealed together, it is preferable that the marginal edge along the top edges of those panels be unsealed for a slight distance from those edges downward to provide a space into which the use can place his/her fingers to peel the peelable seal apart.

Since the package is preferably formed of a fluid impervious material the bowl formed when the package is opened, as described above, can be used to hold any desired liquid therein. For example, if the package is initially filed with a dry cereal in the pouch 40, after the package is opened milk or cream may be poured into the bowl to mix in with the dry cereal, and the cereal/milk mixture can then be eaten directly from the bowl. That action may be accomplished by use of the utensil 12 which had been packaged with the cereal within in the pouch. Alternatively, any other utensil can be used, if desired.

Figure 5:
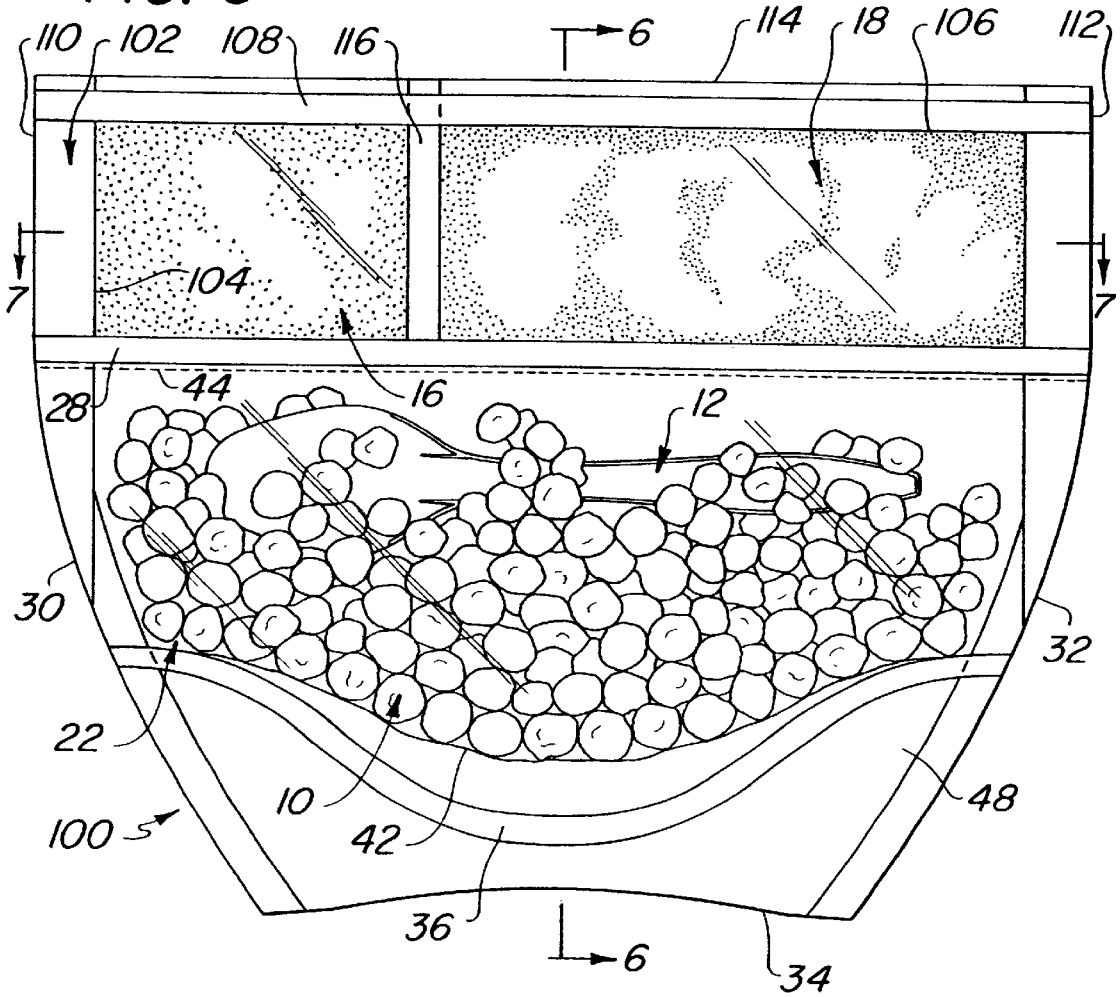
FIG. 5 is a plan view of another embodiment of a flexible package holding a foodstuff therein and which is adapted when opened to serve as a bowl from which the foodstuff may be eaten.
Figure 7:
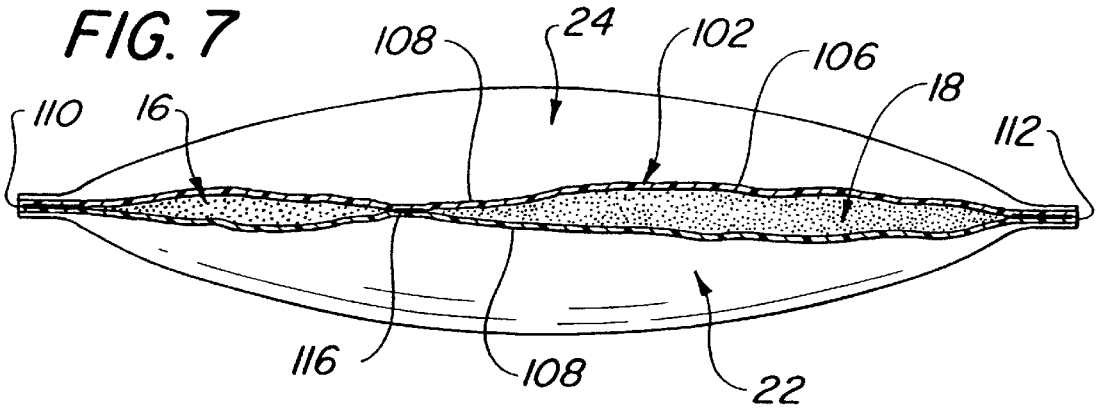
FIG. 7 is a sectional view taken along line 7—7 of FIG. 5.

In FIG. 5 there is shown another embodiment of the package 100 of this invention. The package 100 identical in most respects to the package 20, except that package 100 also includes additional compartments for holding other items, e.g., other edible products associated with the product 10 in the pouch 40, such as sugar 16 and powdered milk 18. Thus, the package 100 includes a portion constructed identically to the package 20 described heretofore plus a "header" structure 102 located above the top edges 28 of the front and rear panels of the bowl-forming portion of the package. The header structure 102 includes two openable compartments 104 and 106, to be described hereinafter, for holding sugar 16 and powdered milk 18, respectively. In the interests of brevity the common components of the packages 20 and 100 which form the bowl will be given the same reference numbers and their construction and operation will not be reiterated.

The header structure 102 basically comprises an extension of the front and rear panels 22 and 24, respectively. In particular, the front panel 22 includes a rectangular section 108 extending from its top seal line 28 upward. The rectangular section 108 includes a pair of linear side marginal edges 110 and 112 and a linear top marginal edge 114. The rear panel 24 also includes an identical rectangular section 108 extending from its top seal line 28 upward.

The side marginal edges 110 and 112 of the section 108 of the front panel 22 are permanently secured to the corresponding side marginal edges of the section 108 of the rear panel 24 by any conventional technique, e.g., heat sealing, welding, adhesives, etc., such as used to form the side seals 30 and 32. The top marginal edge 114 of the section 108 of the front panel 22 are similarly permanently secured to the corresponding top marginal edge 114 of the section 108 of the rear panel 24. A vertical linear mid-seal 116 is provided between the side marginal edges 110 and 112 to form the two heretofore identified compartments 104 and 106. The mid-seal 116 may also be made by any conventional technique.

In order to provide access to the contents of the compartments 104 and 106, the extension sections 108 of the front and rear panels is severable along any suitable line(s), e.g., a transverse line across the package 100 from one marginal side edge to the other and immediately below the top marginal edge seal 114 to communicate with the interior of the compartments 104 and 106. The line may be severed by means of a scissors, knife or other cutting tool. Alternatively the sever line may be weakened to enable it to be torn therealong. In lieu of a sever line, the package may be constructed so that the seal along the top marginal edges 114 is peelable to provide access to the interior of the compartments 104 and 106.

Use of the package 100 is identical to that described earlier with respect to package 20. Thus, to open the package 100 and form the bowl the package is severed or otherwise opened along the sever line 44. This action not only creates the bowl, but also separates the header 102 from the bowl. The contents of the compartments 104 and 106 of the header can now be accessed by severing the header along its "sever" line(s).

Figure 6:
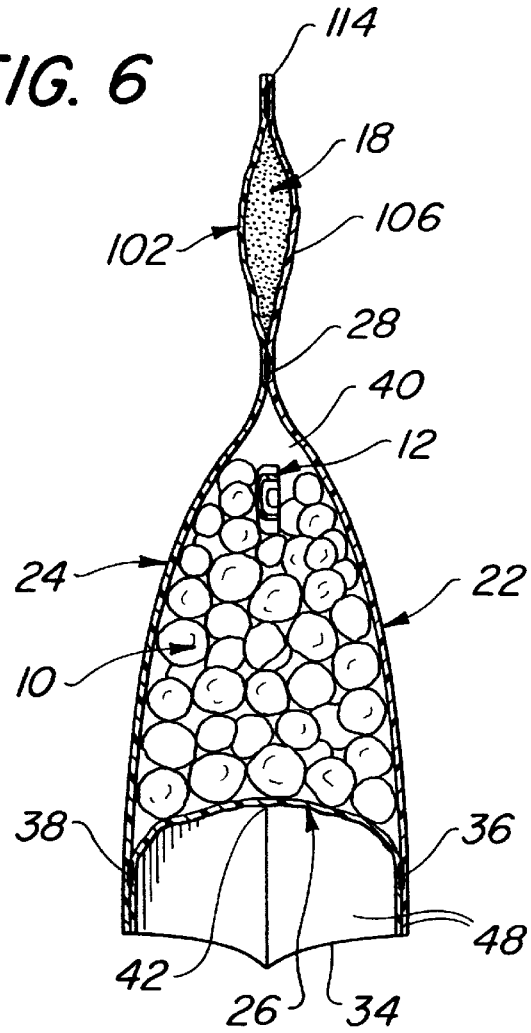
FIG. 6 is a sectional view taken along line 6—6 of FIG. 5.
Figure 9:
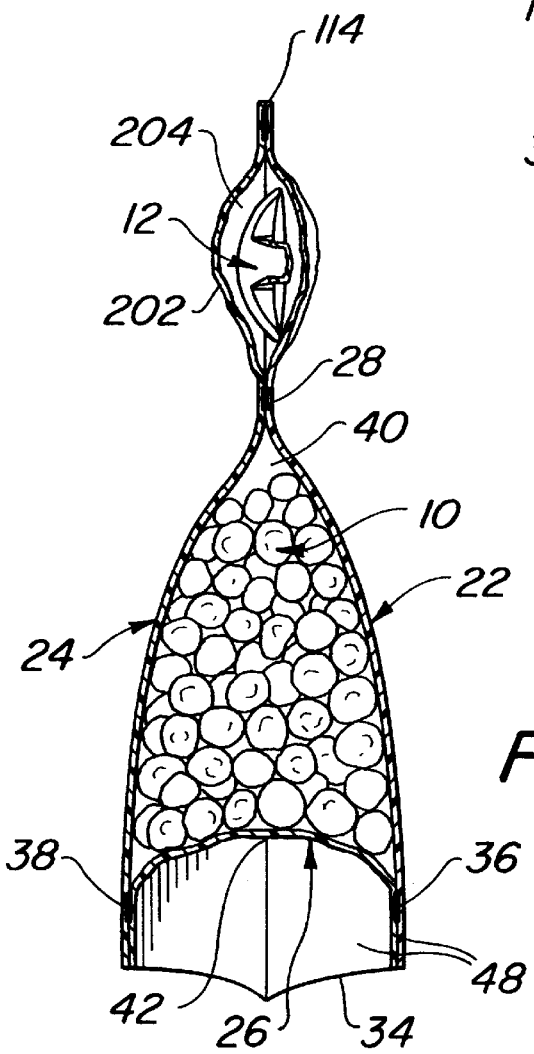
FIG. 9 is a sectional view taken along line 9—9 of FIG. 8.

As can be seen clearly in FIGS. 5 and 6, the package 100 also includes a utensil 12, e.g., a spoon, packaged in the pouch 40 holding the edible product 10.

Figure 8:
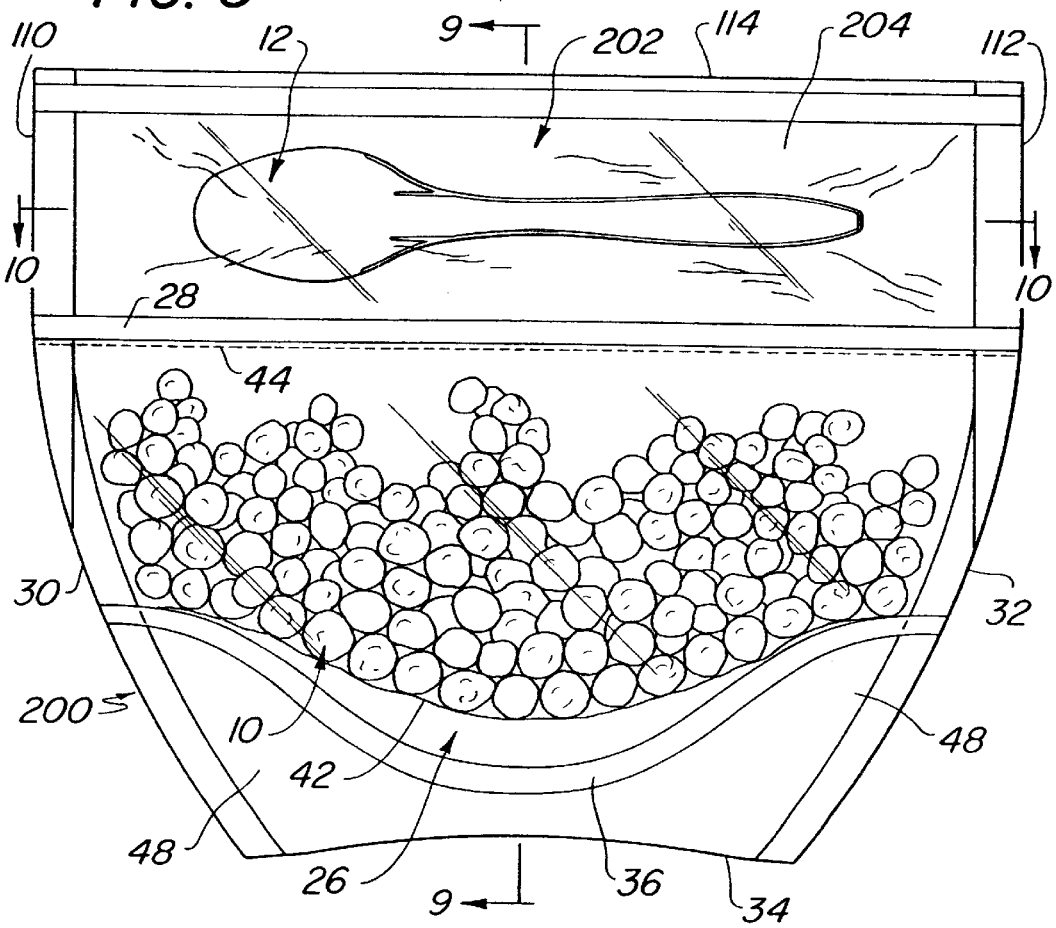
FIG. 8 is a plan view of still another embodiment of a flexible package holding a foodstuff therein and which is adapted when opened to serve as a bowl from which the foodstuff may be eaten.
Figure 10:
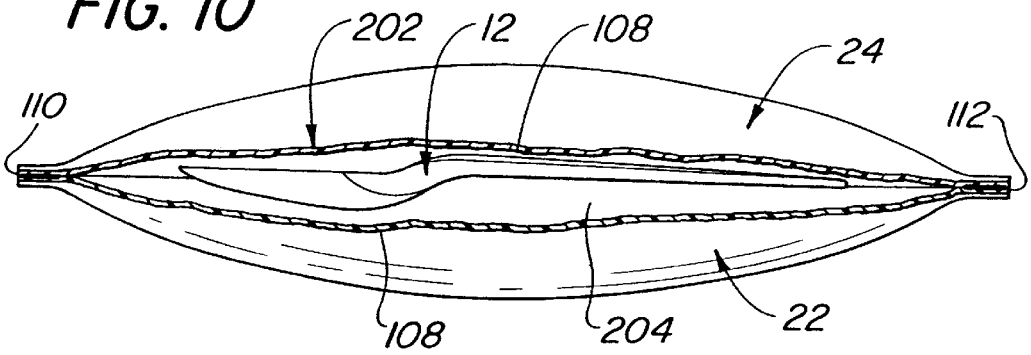
FIG. 10 is a sectional view taken along line 10—10 of FIG. 8.

Alternatively, the spoon 12 may be held within another compartment in a package constructed in accordance with this invention. For example, in FIG. 8 there is shown another alternative embodiment of a package 200 constructed in accordance with this invention. The package 200 is identical in most respects to the packages 20 and 100, except that package 200 only includes a single additional compartment for holding a utensil. In particular, the package 200 includes a portion constructed identically to the bag 20 described heretofore plus a "header" structure 202 constructed similarly to the header 102 of the package 100, but only including a single compartment 204 therein. The header 202 is located above the top edges 28 of the front and rear panels of the bowl-forming portion of the package. In the interests of brevity the common components of the packages 20 and 100 which form the bowl will be given the same reference numbers and their construction and operation will not be reiterated.

Since the header structure 202 of the package 200 only includes a single openable compartment 204 for holding the spoon (or other utensil), it does not include the heretofore identified mid-seal 116. Accordingly the compartment 204 for the spoon or other utensil extends virtually the full width of the header 202.

Figure 11:
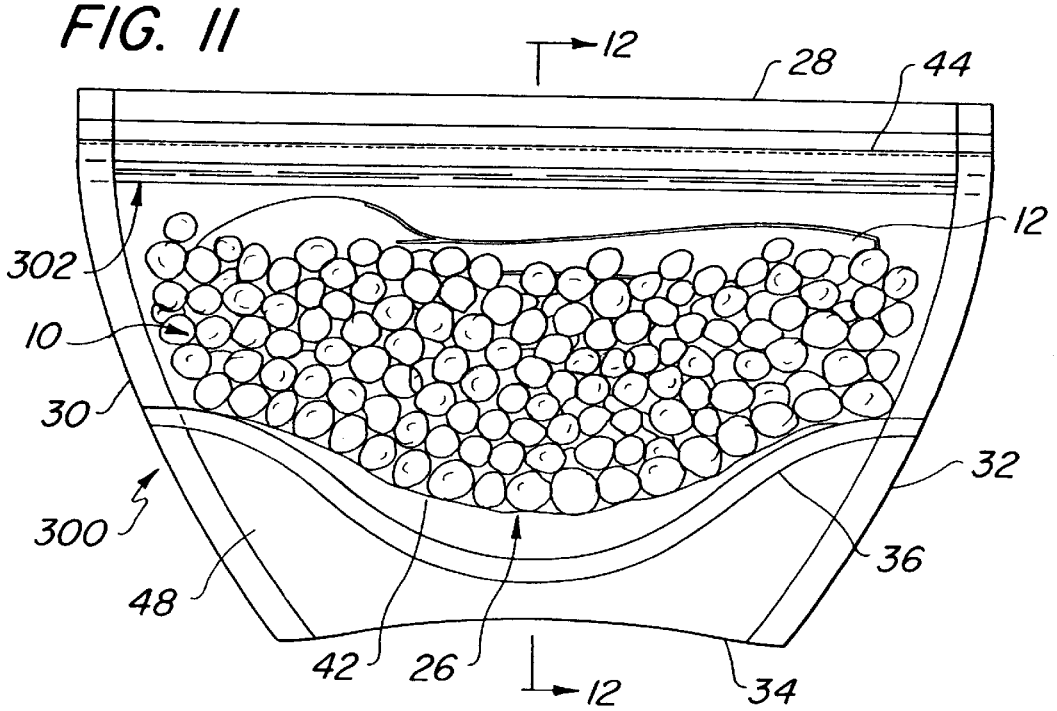
FIG. 11 is a is a plan view of one embodiment of a flexible package holding a foodstuff therein similar to the embodiment of FIG. 1, except that the embodiment of FIG. 11 includes a closure which enables the package to be reclosed after it has been initially opened to form the bowl.
Figure 12:
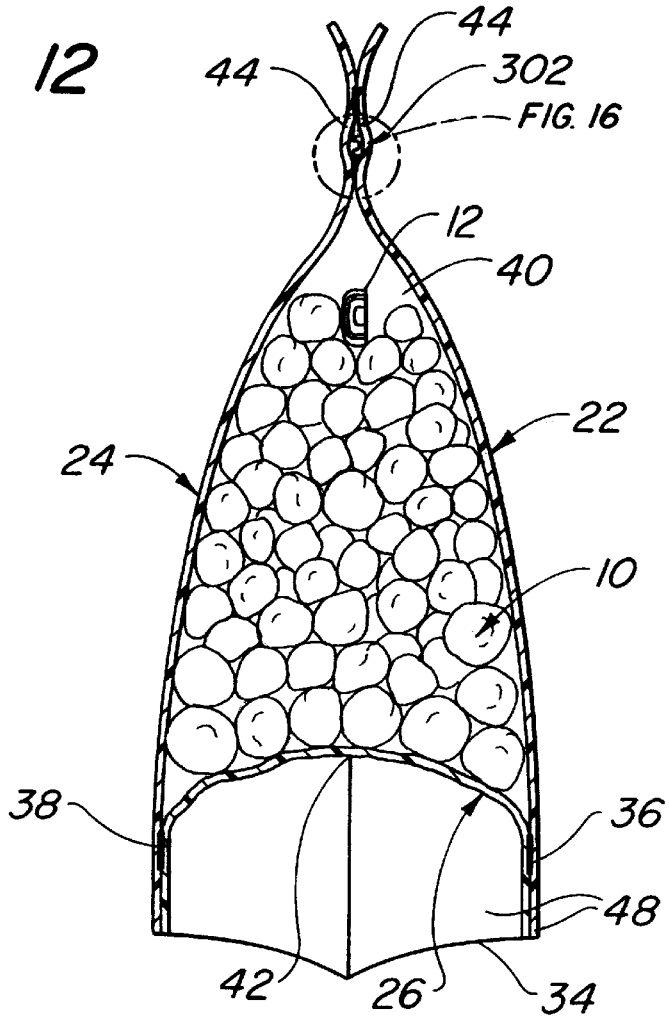
FIG. 12 is an enlarged sectional view taken along line 12—12 of FIG. 11.
Figure 13:
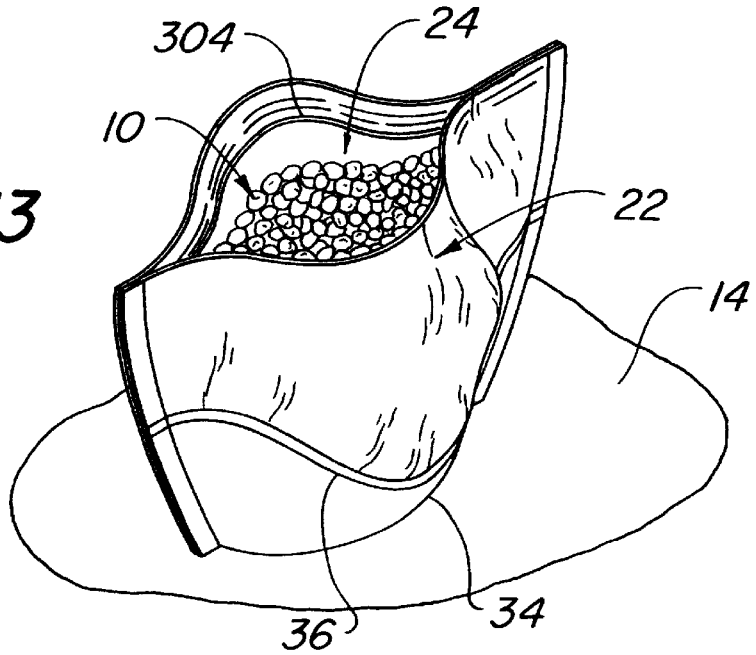
FIG. 13 is an isometric view similar to FIG. 2, but showing the package of FIG. 11 after it has been opened to form the bowl.

In FIGS. 11–13 there is shown another embodiment of a package 300 constructed in accordance with this invention. The package 300 is virtually identical to the embodiment 20 shown in FIG. 1, except that the package 300 includes a resealable securable closure 302 located therein to enable the reclosing of the bowl of the package after that bowl has been formed when the package is initially opened (as described earlier with respect to the embodiment 20 of FIG. 1). Thus, a package constructed in accordance with this aspect of the invention can be readily reclosed after the user has eaten and/or dispensed some of the bowl's contents 10, so that any remaining contents 10 can be held in the reclosed package isolated from the ambient atmosphere to maintain its freshness for later use. Since the package 300 is as virtually identical to the package 20, the common features of the packages 300 and 20 will be given the same reference numbers and the details of the structure and function/operation of such features will not be reiterated in the interest of brevity.

As best seen in FIGS. 11 and 12 the resealable securable closure 302 of the package 300 is located between the inside surfaces of the front and rear panels, 22 and 24, immediately below the sever line 44. The closure 302, basically comprises a pair of mating male and female members 304 and 306 that are arranged to be pulled apart as the front and rear panels are pulled apart to form the bowl (as described earlier with respect to the package 20). In the exemplary embodiment shown in FIG. 11, the resealable securable closure 302 comprises a zipper-type closure whose details will be described hereinafter with particular reference to FIG. 16. However, before describing the closure 302 it should be pointed out that any resealable securable closure used for flexible packages may be used in this invention, whether it includes a mating male and female member or otherwise, so long as it is arranged to be opened and reclosed to seal and/or isolate the contents of the package from the ambient atmosphere.

As mentioned above, in the exemplary embodiment of FIG. 11 the closure is a zipper-type closure. In particular, closure 302 basically comprises a pair of mating male and female members in the form of elongated strips 304 and 306 (FIG. 16) of any suitable material, e.g., a somewhat flexible plastic. The strip 304 can be considered the male member and as best seen in FIG. 16 basically comprises a generally planar base section 308 extending the full width of the package 300 and having an elongated rib 310 projecting upward therefrom. The strip 304 is arranged to be fixedly secured, e.g., thermally bonded or welded or adhesively secured, e.g., via an adhesive layer, on the inner surface of one of the front or rear panels 22 or 24, respectively, below the sever line 44. In the exemplary embodiment shown the strip 304 is secured to the inner surface of the rear panel 24. The strip 306 can be considered the female member and basically comprises a generally planar base section 312 extending the full width of the package 300 and having an opposed pair of arcuate walls 314 and 316 projecting upward therefrom to form a recess or groove 318 therebetween. The strip 306 is arranged to be fixedly secured, e.g., thermally bonded or welded or adhesively secured, e.g., via an adhesive layer, on the inner surface of the other of the front or rear panels 22 or 24, respectively, below the sever line 44 and confronting the strip 304. In the exemplary embodiment shown the strip 306 is secured to the inner surface of the front panel 22. The two strips 304 and 306 are also thermally bonded or welded together at their respective ends, i.e., the side edges of the package 300.

It should be pointed out at this juncture, that the strips 304 and 306 can be formed integrally with the plastic material making up the package's panels in lieu of being separate components which are secured to the panels of the package. In such an alternative arrangement, the rib 310 will be molded integral with the panel 24 and will project inward from the inner surface thereof, while the arcuate walls 314 and 316 are molded integral with the panel 22 and project inward from the inner surface thereof.

In either case, the strips making up the closure 302 may be initially resealable secured together when the package 300 is filled and sealed so that the closure 302 seals the interior of the package immediately below the sever line 44. Since the strips 304 and 306 are somewhat flexible, the rib 310 of the strip 304 can be withdrawn out of the groove 318 of the strip 306 when the package's panels 22 and 24 are peeled apart during the initial opening of the package, thereby enabling the formation of the bowl as shown in FIG. 13. If desired, the strips 304 and 306 may be left unsecured to each other when the package is initially filled and sealed. This arrangement may facilitate the opening of the package (e.g., the package may be easier to open since the strips are not secured to each other so that the rib 310 doesn't have to be pulled out of the groove 318 during the initial opening of the package).

Resealing or reclosure of the package 300 can be readily accomplished by merely squeezing one end portion of the two confronting strips 304 and 306 between one's index finger and thumb and then sliding one's hand across the package 300 from the one end to the other, while continuing to squeeze on the package and the interposed strips. This action causes the portion of the rib 310 closest to the end squeezed to enter the groove 318 at the point of initial squeezing, with consecutive portions of the rib entering the corresponding portions of the groove with continued sliding of the squeezing engagement, until the entire rib 310 is within the groove 318. Accordingly, the strips 304 and 306 are resealably secured together across the full width of the package to effectively seal any remaining contents 10 within the package to keep such contents fresh or otherwise protected from spoilage or degradation by isolating them from the ambient atmosphere.

Figure 14:
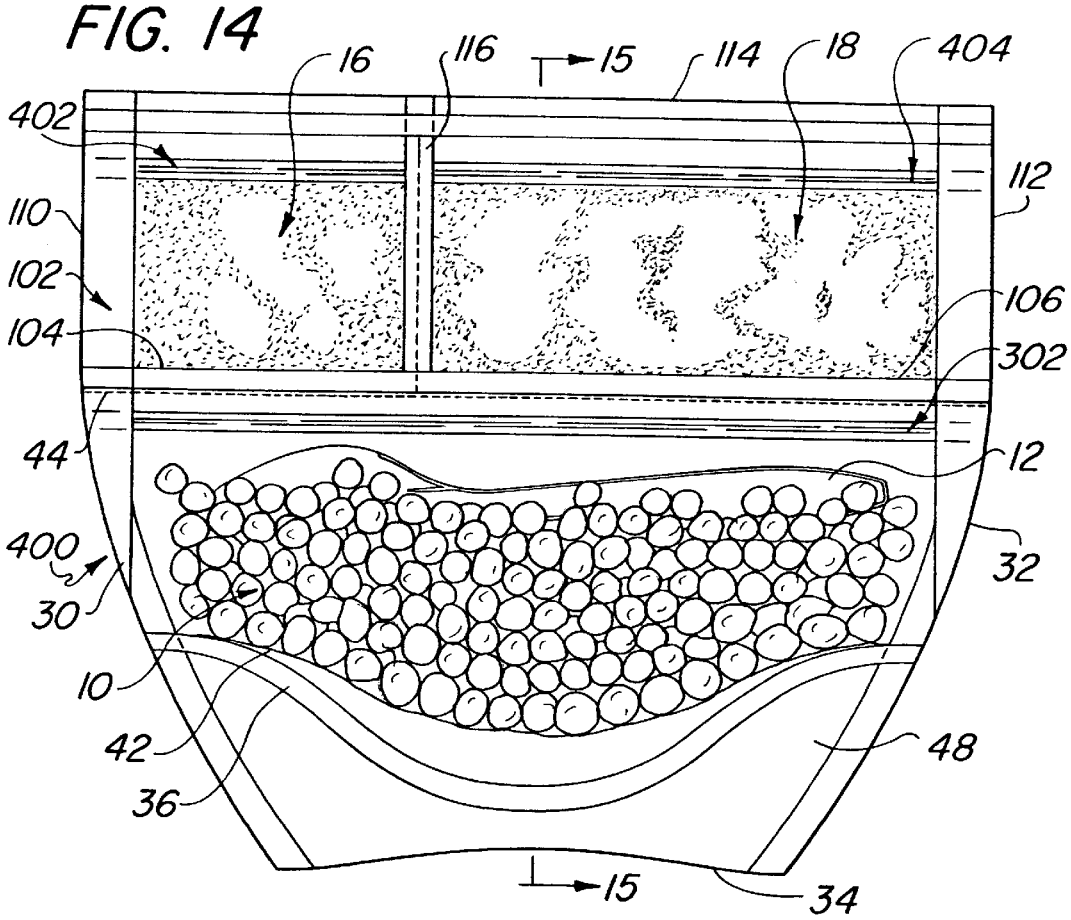
FIG. 14 is a plan view of one embodiment of a flexible package holding a foodstuff therein similar to the embodiment of FIG. 5, except that the embodiment of FIG. 14 includes a closure which enables the package to be reclosed after it has been initially opened to form the bowl.

In FIGS. 14 and 15 there is shown another alternative embodiment of a package 400 constructed in accordance with this invention. The package 400 is also of the reclosable type (like the package 300) and is virtually identical to the embodiment 100 shown in FIG. 5, e.g., it includes a bowl-forming portion and a header made up of two compartments, except that the package 400 includes a three resealable securable closures 302, 402, and 404 located therein. Since the package 400 is as virtually identical to the package 100, the common features of the package 400 to the package 100 will be given the same reference numbers and the details of the structure and function/operation of such features will not be reiterated in the interest of brevity. Moreover, the closure 302 of package 400 is identical to the resealable securable closure 302 of the package 300, so the details of that closure's construction and operation will also not be reiterated. Suffice it for now to state that the closure 302 is located between the inside surfaces of the front and rear panels, 22 and 24 and enables one to reclose the bowl portion of the package 400 after the bowl portion has been formed during the initial opening of the package. The package 400 is opened in the same manner as described with reference to the package 200, except for the fact that when the package's front and rear panels are pulled apart the closure 302 will open at the same time.

The closure 402 forms a portion of the package's header 102 and enables the reclosing of one of the header's compartments, i.e., compartment 104, while the closure 404 also forms a portion of the header and enables the reclosing of the other of the header's compartments, i.e., 106. Thus, the materials held within either or both of those compartments may be resealed therein to maintain their freshness after the compartment(s) has(have) been opened.

Each of the resealable securable closures 402 and 404 is of an identical construction. In particular each comprises a zipper-type closure is constructed like closure 302. It should be pointed out that the closures 402 and 404, like the closure 302 described heretofore, may take various forms other than a zipper-type closure. Thus, any type of resealable securable closure arranged to be opened and reclosed to seal associated compartment may be used herein.

In the exemplary embodiment of FIGS. 14 and 15 the zipper-type closure 402 basically comprises a pair of mating elongated strips 304 and 306 formed of any suitable material, e.g., a somewhat flexible plastic. The strip 304 can be considered the male member and basically comprises a generally planar base section 308 extending the width of the package's compartment 106 between marginal seal 110 and intermediate or mid-seal 116. The strip 304 includes an elongated rib 310 projecting upward from its base section. The strip 304 is arranged to be fixedly secured, e.g., thermally bonded or welded or adhesively secured, on the inner surface of the extension section 108 of the rear panel 24 below the seal line at the top edge 114 between the seals 110 and 116. The strip 306, which can be considered the female member, basically comprises a generally planar base section 312 extending the width of the package's compartment 104 between the marginal seal 110 and the intermediate or mid-seal 116. The strip 306 includes an opposed pair of arcuate walls 314 and 316 projecting upward from its base section to form a recess or groove 318 therebetween. The strip 306 is arranged to be fixedly secured, e.g., thermally bonded or welded or adhesively secured, on the inner surface of the extension section 108 of the front panel 22 below the top edge 114 between seals 110 and 116 and confronting the strip 304. The closure 404 is similarly constructed, located and mounted in the header compartment 106, i.e., the strips 304 and 306 are secured between the marginal seal 312 and the intermediate or mid-seal 116 on the extension sections 108 forming the compartment 106.

Resealing or reclosure of either or both of the package header's compartments 104 and 106 can be readily accomplished by merely squeezing one end portion of the two confronting strips forming the closure for that compartment between one's index finger and thumb and then sliding one's hand across the width of the compartment from the one end to the other, while continuing to squeeze on the package and the strips. This action causes the portion of the rib closest to the end squeezed to enter the groove at the point of initial squeezing, with consecutive portions of the rib entering the corresponding portions of the groove with continued sliding of the squeezing engagement until the entire rib is within the groove. Accordingly, the confronting strips are resealably secured together across the full width of the compartment to effectively seal any remaining contents within the compartment to keep such contents fresh or otherwise protected from spoilage or degradation by isolating them from the ambient atmosphere.

As should be appreciated from the foregoing the various packages of this invention each serve as a viable means to hold edible products under conditions, e.g., hermetic sealing, to maintain the freshness of the products over extended periods of time. Owing to their construction the packages may be readily opened to expose the contents of the packages, thereby automatically converting the packages into bowl like members from which the products can be eaten. Moreover, the packages are constructed so that their dual function capability is readily apparent to the user. Further still unlike the prior art packages, the packages of this invention doesn't require the user to modify his/her habits to accommodate any shortcomings of the package, e.g., eating through a narrow opening or slit, or from an unstable or poorly shaped package. Instead when the package is opened it is converted into a bowl-like configuration from which the foodstuff contained therein can be readily eaten. Thus, the packages of the present invention when opened substantially replicates the shape and stability of a conventional bowl. Moreover, the packages of this invention are simple in construction, can be fabricated at relatively low cost and are aesthetically pleasing in appearance. They can be used to hold a wide variety of dry, liquid, or gelled edible products. Thus, it should be understood that the dry cereal, the powdered milk and sugar disclosed herein are merely exemplary of any edible product which is desired to be housed within a package for conversion to a bowl to enable one to eat the product directly therefrom. Further still, the subject packages provide ready means for holding one or more utensils for use with the product held in the bowl-forming pocket or for use with other edible products held in associated compartments of the header.

Without further elaboration the foregoing will so fully illustrate my invention that others may, by applying current or future knowledge, adopt the same for use under various conditions of service.

I claim:

1. A flexible package having an interior for holding a foodstuff therein, said package comprising a unitary flexible wall front panel, a unitary flexible wall rear panel, and a bottom panel, said front and rear panels each including a top edge, a bottom edge, a pair of side edges flaring outwardly from said bottom edge toward said top edge, an exterior surface and an interior surface, said front and rear panels being fixedly secured together at their interior surfaces along said side edges, said bottom panel having a peripheral edge, said bottom panel being fixedly secured along a first portion of said peripheral edge to said interior surface of said front panel above said bottom edge and being fixedly secured along a second portion of said peripheral edge to said interior surface of said rear panel above said bottom edge to form a hollow flaring wall pocket containing a foodstuff therein, said package being arranged to be sealed along said top edge of said front and rear panels to isolate the foodstuff in said pocket from the ambient atmosphere to maintain the freshness of said foodstuff, said front and rear panels being arranged to be separated from each other contiguous with said top edge to form a bowl-shaped member in which the foodstuff is located to facilitate the eating and/or preparation of the foodstuff within said bowl-shaped member, said bowl-shaped member having a sidewall flaring outwardly from said bottom edge toward said top edge and a bottom wall, said bottom edges of said front and rear panels forming a support base for said bowl-shaped member, said package additionally comprising a resealable securable closure for closing said bowl like member after the formation thereof.

2. The package of claim 1 wherein said resealable securable closure is located adjacent said top edge.

3. The package of claim 1 wherein said resealable securable closure comprises a zipper-type closure.

4. The package of claim 3 wherein said front and rear panel each include an inner surface and wherein said zipper-type closure comprises a first elongated member and a second elongated member, said first elongated member having a longitudinally extending rib and being fixedly secured to said inner surface of one of said front and rear panels adjacent said top edge, said second elongated member having a longitudinally extending groove and being fixedly secured to said inner surface of the other of said front and rear panels adjacent said top edge, said rib being arranged to be resealable received in said groove.

5. The package of claim 1 additionally comprising an eating utensil.

6. The package of claim 5 wherein said eating utensil is located within said pocket.

7. The package of claim 1 wherein said package includes a header portion for holding another item therein.

8. The package of claim 7 wherein said header portion comprises an extension section from said front panel and an extension section from said rear panel.

9. The package of claim 8 wherein said extension sections include marginal edges and wherein said marginal edges of said extension sections are secured together to form at least one compartment therebetween.

10. The package of claim 9 wherein said package additionally comprising at least one other resealable securable closure.

11. The package of claim 10 wherein said at least one other resealable securable closure comprises a zipper-type closure.

12. The package of claim 11 wherein said extension sections each include an inner surface, and wherein said at least one other resealable securable zipper-type closure comprises a first elongated member and a second elongated member, said first elongated member having a longitudinally extending rib and being fixedly secured to said inner surface of one of said extension sections, said second elongated member having a longitudinally extending groove and being fixedly secured to said inner surface of the other of said extension sections, said rib being arranged to be resealably received in said groove.

13. The package of claim 7 additionally comprising at least one other item located in said header.

14. The package of claim 13 wherein said at least one other item comprises an eating utensil.

15. The package of claim 13 wherein said at least one other item comprises an edible material.

* * * * *